United States Patent [19]

Grebe

[11] Patent Number: 4,617,690

[45] Date of Patent: Oct. 21, 1986

[54] INFLATABLE BED PATIENT MATTRESS

[75] Inventor: Alfred H. Grebe, Richmond, Va.

[73] Assignee: Whittaker Corporation, Los Angeles, Calif.

[21] Appl. No.: 689,268

[22] Filed: Jan. 7, 1985

[51] Int. Cl.[4] ..... A61G 7/04; A47C 27/10

[52] U.S. Cl. ..... 5/453; 5/455

[58] Field of Search ..... 5/453, 454, 455, 456, 5/449, 469, 464

[56] References Cited

U.S. PATENT DOCUMENTS

| | | | |
|---|---|---|---|
| 595,734 | 12/1897 | Rand et al. | 5/455 |
| 2,491,557 | 12/1949 | Goolsbee | 5/455 |
| 2,938,570 | 5/1960 | Fladole | 5/456 |
| 2,998,817 | 9/1961 | Armstrong . | |
| 3,199,124 | 8/1965 | Grant . | |
| 3,303,518 | 2/1967 | Ingram | 5/456 |
| 3,653,083 | 4/1972 | Lapidus | 128/33 |
| 3,705,429 | 12/1972 | Nail | 5/457 |
| 3,740,777 | 6/1973 | Dee . | |
| 3,999,539 | 12/1976 | Meador | 128/33 |
| 4,161,794 | 7/1979 | Darnfors | 5/441 |
| 4,225,989 | 10/1980 | Corbett et al. | 5/455 |
| 4,267,611 | 5/1981 | Agulnick | 5/453 |
| 4,279,044 | 7/1981 | Douglas | 5/453 |
| 4,391,009 | 7/1983 | Schild | 5/453 |
| 4,435,864 | 3/1984 | Callaway | 5/453 |

FOREIGN PATENT DOCUMENTS

| | | | |
|---|---|---|---|
| 1138200 | 10/1962 | Fed. Rep. of Germany | 5/455 |
| 1456058 | 10/1966 | France | 5/455 |
| 122806 | 2/1919 | United Kingdom | 5/455 |
| 823166 | 11/1959 | United Kingdom . | |
| 449652 | 2/1964 | United Kingdom . | |
| 1440193 | 6/1976 | United Kingdom | 5/455 |
| 1545806 | 5/1979 | United Kingdom | 5/455 |

*Primary Examiner*—Alexander Grosz

*Attorney, Agent, or Firm*—Donald E. Nist

[57] ABSTRACT

The mattress includes a hollow, elongated, fluid-inflated mattress body which may be permanently inflated or inflatable and deflatable by connection with a suitable inflation device. The mattress also includes a selectively inflatable patient support component which is disposed generally centrally of the mattress body and is connected thereto. The support component includes a number of cells which are individually connected to a device capable of individually inflating and deflating each of the cells to facilitate support of the patient's body, while lying on the mattress, and to minimize the development of bed sores. The support component inflation device preferably is both manually and automatically controlled. The support component's cells may be elongated, parallel, preferably transversely extending tubes, or a grid of inflatable pockets or the like. In one embodiment, the mattress body comprises a number of contiguous, longitudinally extending tubes connected to a manifold and simultaneously inflatable and deflatable. The mattress has improved properties over conventional inflatable mattresses.

3 Claims, 3 Drawing Figures

INFLATABLE BED PATIENT MATTRESS

BACKGROUND OF THE INVENTION

1. Field of the Invention

Figure 1:
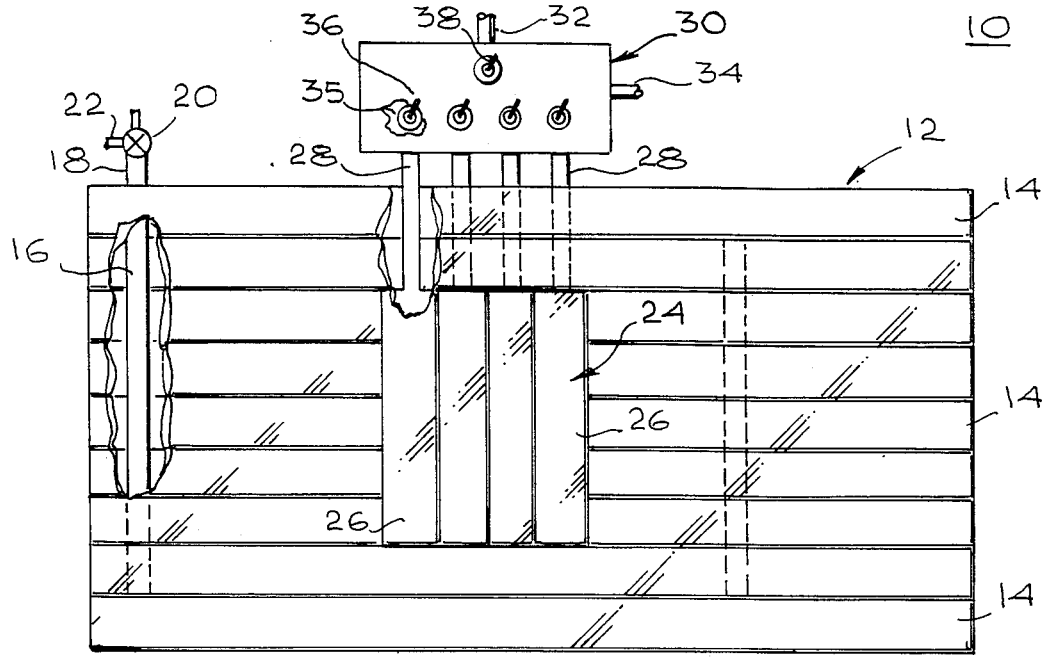

The present invention generally relates to patient support devices and more particularly to an improved mattress which is selectively regionally inflatable by the patient.

2. Prior Art

The problem of bed sores developing in patients lying for extended times on hospital beds is substantial. The problem is particularly severe in cases of patients in immobilized or comatose conditions due to surgery, injury and/or old age. In order to avoid bed sores in such circumstances, it is necessary to manually move the patient frequently to allow access of air to various parts of the patient's skin and to relieve continued pressure against those skin parts. This necessarily involves a considerable amount of time and cost on the part of hospital and nursing home personnel.

The bed sore or decubitis ulcer problem has been addressed recently by a number of inventions which involve the use of fluidfilled mattresses, which can be periodically inflated and deflated to intermittently support the patient at different points of the body, thus allowing periodic reduction of skin pressure and access to air. For example, U.S. Pat. No. 3,199,124 is directed to an air mattress which has a plurality of tubes extending the full length of the mattress and which form two alternating sets. The tubes of one set are all inflated to the same pressure while the tubes of the other set are all deflated. Thus, the two sets alternately inflate and deflate in order to reduce the chance of bed sores. Unfortunately, the use of such a mattress does not eliminate the bed sore problem, particularly because the patient may move slightly and in so doing, recompress a skin area which has just been relieved of pressure by the deflation of a tube previously lying under the patient. The inflation and deflation cycle is usually controlled in an automatic manner without reference to the position of the patient. Moreover, the pressure in the tubes is uniform throughout the length thereof and does not address the main problem which arises with such patients, because of the concentration of skin pressure in the bony back, hip and upper thigh regions where most of the patient's weight is supported. Decubitus ulcers may extend down through the skin right to the underlying bones.

U.S. Pat. No. 4,267,611 is directed to an inflatable mattress formed of two sets of tubes which are alternately inflated and deflated. The sets alternate with each other in position and are generally transversely disposed across the mattress. Those tubes are also of generally uniform thickness and support area except at the foot of the mattress. A similar transversely extending dual set of tubes of uniform size and length is disclosed in U.S. Pat. No. 2,998,817. U.S. Pat. Nos. 3,705,429 and 4,391,009 also disclose transversely extending sets of tubes of generally uniform size and length but of more complicated design than in the previously described patents. Even more complicated is the mattress configuration described in U.S. Pat. No. 4,279,044, which configuration is difficult to manufacture, repair and utilize. U.S. Pat. Nos. 3,740,777 and 3,000,539 disclose more exotic versions of body support systems.

All of the above-described devices fail to specifically treat and deal with those areas of the mattress upon which the main support points of the patient lie and also fail to deal with the likelihood that the patient may shift weight intermittently while lying on the mattress. Accordingly, the described devices fail to wholly eliminate bed sores in those patients most subject thereto.

U.S. Pat. No. 4,468,824 discloses an inflatable mattress which has a rectangular central area in the form of an opening or cavity totally devoid of patient support and positioned such that the main pressure areas of the patient, namely the lower back, hip and upper thigh, would be positioned over this cavity, thereby eliminating bed sores in this area. However, the mattress provides no physical support where it is most needed and therefore is totally impractical. Moreover, those areas of the patient's body bordering the cavity actually build up excessive pressure because they must serve as a support for the otherwise unsupported areas, overlying the cavity. Accordingly, danger of decubitus ulcers in those border areas is increased.

Accordingly, there is a need for an improved bed patient mattress which will essentially eliminate the development of bed sores or decubitis ulcers in patients who are most subject to the same. Such device should be simple and inexpensive to construct, use and repair and should also provide optimal physical support, regardless of whether the patient remains totally immobile or shifts his or her weight around on the mattress.

SUMMARY OF THE INVENTION

The improved inflatable bed patient mattress of the present invention satisfies all the foregoing needs. The mattress is substantially as set forth in the Abstract above. Thus, it includes an elongated mattress body which is filled with fluid; either permanently or can be periodically inflated or deflated, as desired. The mattress body can, for example, comprise a plurality of longitudinally extending contiguous tubes connected to the manifold of an air compressor for simultaneous inflation or deflation to the desired degree, depending upon the weight and size of the patient and the overall need for support of the patient's body. The mattress body defines and surrounds a generally central patient support component which is connected thereto. The patient support component is positioned so that it is designed to underlie that area of the patient's body which extends from the lumbar region, through the hip and buttocks and upper thigh, that is, those areas of the patient which support the majority of the patient's weight and are most bony and therefore which are most subject to the development of bed sores.

The patient support component comprises a plurality of transversely extending tubes or cells which are individually inflatable and deflatable and are connected to control means which can be operated by the patient manually, or can be placed in an automatic mode which alternately inflates and deflates selected areas of the support to eliminate or greatly reduce bed sores.

The support component in one embodiment comprises a grid of cells; for example, three rows of three cells each for a total of nine cells, each of the individual nine cells being individually connected through the control means to a pressure source. With this arrangement, when a patient lies on a bed covered by the mattress, that patient will directly overlie the patient support component and can control the particular amount of physical support provided by a given area of the patient support component merely by operating the controls to the individual cells in the support component. Should the patient change position laterally or longitudinally, or both, as by rolling over, the patient can then readjust the alignment of inflated and deflated cells of the support component to provide the desired physical support but also prevent the development of the bed sores. When the patient is asleep, the mattress support component can be placed in an automatic mode, whereby the cells thereof individually cycle between inflation and deflation, adjoining cells in a longitudinal or transverse array at any given time being in opposite modes of pressurization-depressurization.

In one embodiment, the main bulk of the mattress outside of the patient support component described above is permanently inflated, while in another embodiment, it is inflated or deflated to a controlled degree by a suitable lever so as to provide desired physical support to patients of different sizes and weights, etc. The mattress can be made inexpensively of a durable airtight cloth, such as rubberized cloth, or rubber, plastic or similar component(s) and the controls for the mattress can be relatively inexpensive conventional valve control means, electrically, hydraulically or mechanically operated. Various other features of the invention are set forth in the following detailed description and accompanying drawings.

DRAWINGS

Figure 2:
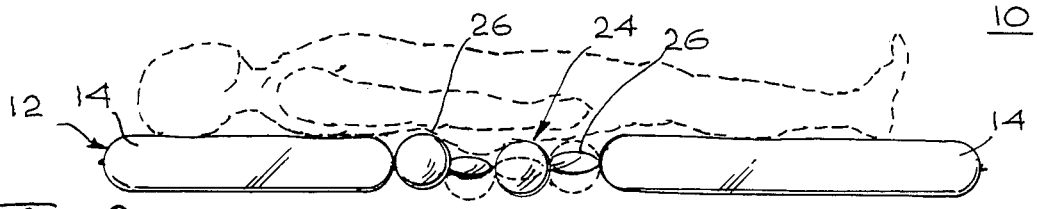
Figure 3:
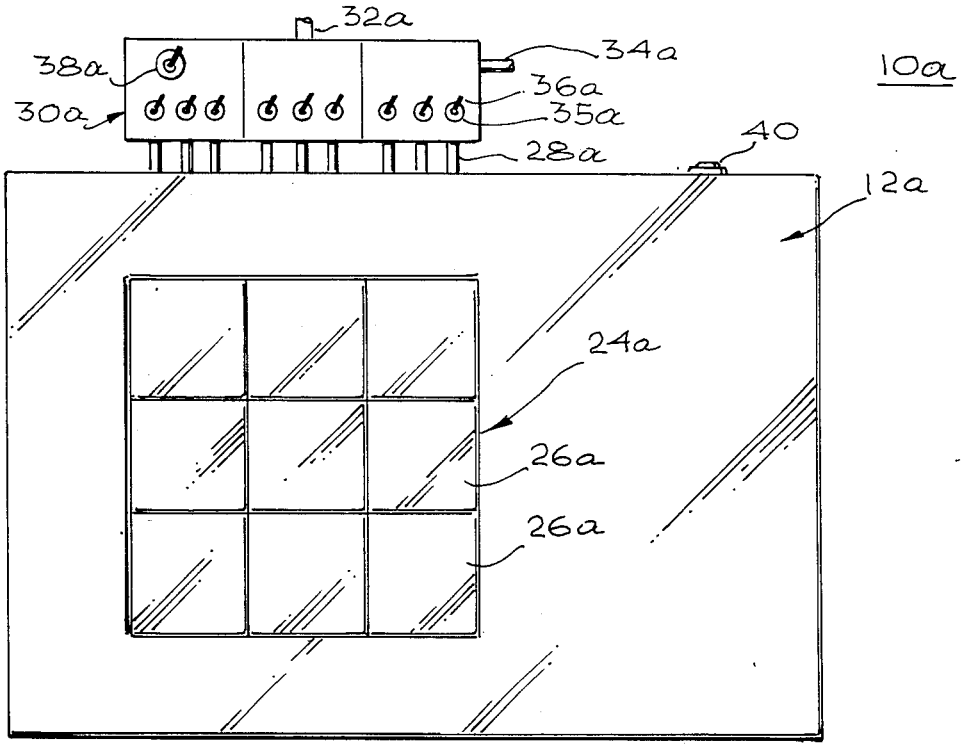

FIG. 1 is a schematic top plan view, partly broken away, depicting a first preferred embodiment of the improved inflatable bed patient mattress of the present invention;

FIG. 2 is an enlarged, fragmentary schematic side elevation of the mattress of FIG. 1, showing a patient in dotted outline lying on the mattress and two of the four transverse tubes of the patient support component in the mattress in the inflated condition while the other two tubes thereof are in the deflated condition; and, FIG. 3 is a schematic top plan view of a second preferred embodiment of the improved inflatable bed patient mattress of the present invention.

DETAILED DRAWINGS

FIGS. 1 and 2.

Now referring more particularly to FIGS. 1 and 2 of the accompanying drawings, the first preferred embodiment of the improved inflatable bed patient mattress of the present invention is schematically depicted therein. Thus, mattress 10 is shown which comprises a hollow, rectangular mattress body 12, comprising a plurality, specifically nine parallel, longitudinally extending, contiguous, hollow inflatable tubes 14, connected by a single transverse passageway 16 to a single valved outlet 18 running to a source of air pressure (not shown). Thus, all of tubes 14 are simultaneously inflatable to the desired degree by air entering through valved entry 18 and passing through passageway 16 in body 12. When a valve 20 in line 18 is turned by the patient or hospital attendant in a pre-selected direction, mattress body 12 can either be inflated or deflated. The exhaust line for this arrangement is shown as tube 22 connected to valve 20. Thus valve 20 is a three-way valve, providing in the three positions, alternately, access to pressure, exhausting of pressure or blockage of line 18 to retain pressure. If desired, valve 20 can be electric solenoid-operated in order to reduce the physical effort which needs to be exerted by the patient or nurse to operate valve 20. It will be understood that the extent of pressure to be exerted by tubes 14 on a patient lying on the same can be varied according to the need of the patient, as dictated by the patient's size, shape, weight and medical condition and the limit of pressure available from the compressor.

Mattress 10 also includes a selectrively inflatable patient support component 24, which is disposed generally centrally of mattress body 12 and surrounded by and connected to it either integrally or separately. Thus, if desired, component 24 can be releasably connected to body 12, and body 12 and/or component 24 can be replaced when worn, damaged, etc.

Support component 24 is specifically dimensioned and located to preferably underlie the lumbar through upper thigh regions of the patient lying on mattress 10 and comprises a plurality, in this instance four, of transversely extending individually inflatable contiguous tubes or cells 26. Each cell 26 is connected by a separate pressure line 28 to a control panel 30 which is in turn connected to a pressure supply source (not shown) by a supply line 32. Panel 30 also includes a pressure exhaust line 34. Panel 30 further includes a three-way valve 35 for each of cells 26. Each valve 35 is connected to both pressure supply line 32 and pressure exhaust line 34, so as to be able to individually control the amount of pressure, if any, in each cell 26 at any given time. If desired, exhaust line 34 could be eliminated and air could be continuously, bled out of pinholes (not shown) piercing cells 26, and fresh air could be continuously supplied to cells 26 by pressure lines 28. Air passing out such pin holes could be used to evaporate perspiration from the patient's skin. Control levers 36 are shown extending from valves 35 through the upper surface of panel 30 so as to permit the patient and/or medical personnel to individually adjust the pressure in each of cells 26.

Panel 30 also includes a conventional automatic pressure control system (not shown) operated by lever 38, necessary to place all of cells 26 in an automatic cycle of inflation and deflation, wherein adjoining cells 26 preferably are in opposite modes of inflation and deflation at any given time. This automatic cycle is used when the patient is asleep and assures that the maximum pressure points for the patient's body tissue, that is, those overlying region 24, will periodically alternately undergo full physical support (high skin pressure) in the inflation stage of the cycle for each cell 26 and low physical support (minimal skin pressure) in the deflation stage of the cycle of each cell 26, so as to eliminate the development of bed sores. While the patient is awake, he or she or a nurse can separately control the individual pressure in each of cells 26 for a maximum comfort and physical support and should the patient shift his or her position, he or she or a nurse can easily readjust the individual pressure in various of cells 26 to suit the occasion.

Accordingly, mattress 10 affords the maximum of individualized pressure adjustment for physical support of the patient while eliminating the development of bed sores, particularly in those areas of the patient's body most subject to the same. Those areas are the ones in which most of the patient's body weight is pressed against the underlying support. It will be understood that the size of support component 24 could be changed in order to suit changes in the mattress and patient size, etc. In some instances, it may be desireable to extend support component 24 to bridge the entire width of mattress 12.

FIG. 3

A second preferred embodiment of the improved inflatable bed patient mattress of the present invention is schematically presented in FIG. 3 of the accompanying drawings. Thus, mattress 10*a* is shown. Components thereof which are similar to the components of mattress 10 bear the same numerals but are succeeded by the letter "a". Mattress 10*a* includes a hollow flexible resilient mattress body 12*a* which is permanently or adjustably inflatable to a desired level through an access port 40. It will be noted that mattress body 12*a* does not include a plurality of longitudinally extending tubes, as called for in mattress 12, but instead is a single large unsegmented enclosure or air or water bag.

Mattress 12*a* defines a patient support component 24*a* comprising nine contiguous cells 26*a* which are generally rectangular and are disposed transversely of mattress 12*a* in a grid pattern as shown in FIG. 3. Each cell 26*a* is individually connected by means of its own tube 28*a* to control panel 30*a* so that there are a total of nine tubes 28*a* leading to separate three-way valves 35*a* disposed within panel 30*a* and connected to individual control switches 36*a* for each cell 26*a*. Valves 35*a* are also connected to a pressure supply line 32*a* and to a pressure exhaust line 34*a* passing in panel 30*a*. Thus, with this arrangement, the individual pressure in each cell 26*a* is controlled by the patient and/or the hospital personnel by a switch 36*a*. Cells 26*a* can also be placed in an automatic cycle of periodic alternate inflation and deflation by operation of an automatic control lever 38*a* shown in FIG. 3 on the top of control panel 30*a*.

The method of operation and advantages of device 10*a* are similar to those of device 10, except that component 24*a* is divided into nine cells 26*a* rather than four transverse tubes 26 as in FIG. 1. Accordingly, more localized regional pressure control for enhancing patient support and elimination of bed sores is provided by device 10*a*.

It will be understood that various other embodiments of the improved mattress of the present invention can be provided while utilizing the basic principles of the invention. Thus, the described valve controls can be mechanical, hydraulic or electrical. Various areas of the mattress body itself in addition to the support region can be made to automatically alternately inflate and deflate. In all instances, however, the highly individualized pressure areas within the central patient support component described above distinguishes this invention from conventional mattresses. Various other features of the invention are set forth in the foregoing description.

Various other modifications, changes, alterations and additions can be made in the improved mattress of the present invention, its components and their parameters. All such modifications, changes, alterations and additions as are within the scope of the appended claims form part of the present invention.

What is claimed is:

1. An improved inflatable bed patient mattress, said mattress comprising, in combination:

(a) a hollow elongated air-inflated mattress body, at least the main portion of which is inflatable and deflatable as a single unit to a uniform pressure;

(b) a selectively air-inflatable patient support component disposed generally central of, totally surrounded by said mattress body and connected thereto, said support component being disposed at a location and being in a size to underlie those portions of a patient's body, when lying on said mattress body, which extend from about the lumbar spinal region to the upper thigh region; said patient support component including a plurality of individually air inflatable cells; and, (c) support component inflation means individually connected to each of said cells for both manually controlling selective powered air inflation and deflation of said cells to individual pressures and for automatic cycling of powered inflation and deflation of said cells to individual pressures to facilitate patient body support and minimize development of decubitis ulcers.

2. The improved mattress of claim 1 wherein said mattress body and said patient support component are generally rectangular, wherein said mattress body comprises a plurality of contiguous, longitudinally extending inflated tubes and wherein said support component comprises a plurality of contiguous transversely extending tubes.

3. The improved mattress of claim 1 wherein said mattress includes a portion which is permanently inflated.

* * * * *